United States Patent [19]

Bocharov et al.

[11] Patent Number: 4,881,399

[45] Date of Patent: Nov. 21, 1989

[54] DOUBLE-ACTION SCREW PRESS

[75] Inventors: Jury A. Bocharov; Anatoly V. Safonov; Anatoly P. Nosov; Jury I. Tamaris, all of Moscow; Evgeny S. Lunkov, Chimkent; Vladimir I. Myakinenkov, Chimkent; Igor Y. Perepechin, Chimkent; Leonid L. Rudman, Kiev; Viktor P. Salov, Voronezh; Igor V. Bovykin, Voronezh; Mark M. Zaidlin, Voronezh, all of U.S.S.R.

[73] Assignees: Moskovskoe Vyschee tekhnicheskoe uchilische imeni N.E.Baumana, Moscow; Experimentalny nauchno-issledovatelsky institut kuznechno-pressovogo mashinostroenia "ENIKMASH", Voronezh., both of U.S.S.R.

[21] Appl. No.: 174,519

[22] PCT Filed: May 29, 1986

[86] PCT No.: PCT/SU86/00054

§ 371 Date: Jan. 28, 1988

§ 102(e) Date: Jan. 28, 1988

[87] PCT Pub. No.: WO87/07210

PCT Pub. Date: Dec. 3, 1987

[51] Int. Cl.[4] ..... B21D 22/00; B21J 9/10

[52] U.S. Cl. ..... 72/454; 72/466; 83/631; 100/289

[58] Field of Search ..... 72/454, 466, 360; 100/282, 289, 271; 83/631

[56] References Cited

U.S. PATENT DOCUMENTS

| | | | |
|---|---|---|---|
| 4,590,787 | 5/1986 | Trimborn | 72/454 |

FOREIGN PATENT DOCUMENTS

| | | | |
|---|---|---|---|
| 0617280 | 7/1978 | U.S.S.R. | 72/454 |
| 617280 | 7/1978 | U.S.S.R. . | |
| 0706173 | 1/1980 | U.S.S.R. | 72/454 |
| 658005 | 8/1980 | U.S.S.R. . | |
| 854740 | 8/1981 | U.S.S.R. . | |
| 1027056 | 7/1983 | U.S.S.R. . | |

*Primary Examiner*—David Jones

*Attorney, Agent, or Firm*—Fleit, Jacobson, Cohn, Price, Holman & Stern

[57] ABSTRACT

A double-action screw press is proposed, wherein a mechanism for braking an outer slide when it approaches the extreme bottom position is disposed on the face surface of the slide. The mechanism comprises a plate provided with a device for movement along the longitudinal axis of a screw, four elastic elements arranged on the plate, a pair of which, by a traverse are kinematically associated with a second stop. The latter is installed in the traverse for turning and interacts by its face surface with the face surface of a first stop. In addition, the press is provided with a third stop rigidly coupled with a frame and interacting with the plate when the outer slide approaches the extreme bottom position.

4 Claims, 3 Drawing Sheets

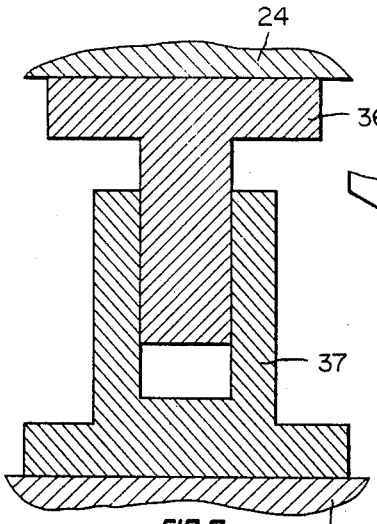
FIG. 3
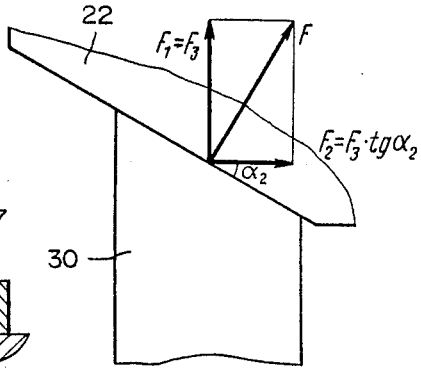
FIG. 5 $F_3$
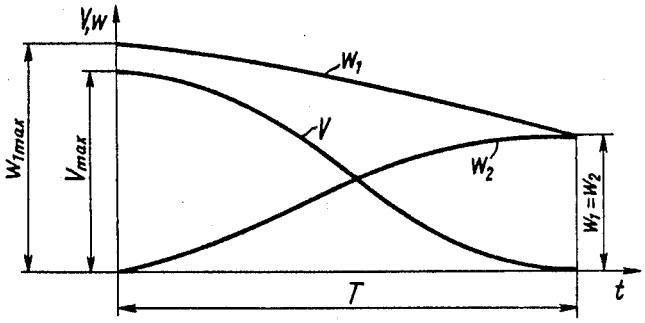
FIG. 6

DOUBLE-ACTION SCREW PRESS

TECHNICAL FIELD

The present invention relates to mechanical engineering and more specifically to a double-action screw press.

The present invention may be most efficiently used in press-forging and particularly in closed-die forging.

The present invention may be used advantageously for producing precision parts of a complicated configuration from ordinary and difficult-to-form metals and alloys for gear pumps, gears, couplings, stepped shafts, T-pieces, cross-pieces, gas-turbine engines, fuel feed control equipment, etc.

Parts are conventionally worked by using a method of closed-die forging in which cylindrical blanks are deformed in one stroke. In using double-action screw presses for closed-die forging, an elastic collision of the dies takes place when the outer slide approaches the extreme bottom position, due to which the outer slide together with the top die rebounds upwards, thereby causing an opening of the joint between the dies. At the moment when the outer slide rebounds, the inner slide with the press tool secured thereon starts to move downwards at an increased speed and deforms the blank with the joint between the dies open. This leads to splashing of the metal out of the dies and, as a rule, results in spoilage.

PRIOR ART

Attempts to solve the problem associated with braking the outer slide when it approaches the extreme bottom position, i.e. to reduce the speed of the outer slide so that the moment the press tool dies start to close, this speed equals or is close to zero, resulted in the development of a double-action screw press according to USSR Inventor's Certificate No. 854,470, cl. B30B 1/18 published in the Bulletin "Discoveries, Inventions, Industrial Designs, Trade Marks" No. 30, 1981.

The known screw press comprises a frame with guideways and a first screw installed for rotation along the longitudinal axis of the frame. One end of the screw is kinematically associated with slides and the other end thereof is rigidly coupled with a flywheel rotated by any known drive. Disposed in the guideways coaxially with the first screw is an outer slide incorporating two intercommunicated spaces. One of them, the lower space that faces the press tool, accommodates an inner slide while the other space houses a carrying element which is essentially a nut body in engagement with the first screw. The nut body is rigidly coupled with a hollow screw in the inner space of which the first screw is freely disposed. The hollow screw is in engagement with a nut rigidly coupled with the inner slide.

The known press is provided with a mechanism for braking the outer slide when it approaches the extreme bottom position. This mechanism comprises a traverse installed for movement along the longitudinal axis of the press in the guideways secured on the press frame, and at least two elastic elements rigidly installed on the frame above the outer slide when it is in the extreme top position. A threaded hole is made in the traverse. On the side facing the flywheel, the nut body is provided with a thread opposite in direction relative to the thread of the screw. The threaded portion of the nut body is in engagement with the threaded hole in the traverse.

When the outer slide approaches the extreme bottom position the nut body moves the traverse along its guideways. The traverse interacts with the elastic elements.

The double-action screw press of the known design has a low efficiency because of the energy losses in overcoming the frictional forces arising in the nut body-to-traverse threaded joint when the outer slide approaches the extreme bottom position, as the inner slide moves for accomplishing the process of deformation and as the inner slide returns into the initial position relative to the outer slide.

A rise of the energy losses in the threaded joint is explained by the fact that the joint has a constant and large area of contact between the nut body and the traverse which leads to an increase in the resisting moment to rotation of the nut body in the traverse.

In addition, the provision of the thread on the nut body makes it necessary to manufacture the latter from expensive alloyed steels which leads to an increase in the press costs.

Attempts to improve the efficiency of the doubleaction screw press at the expense of reducing the frictional losses resulted in the development of another known screw press (Cf. USSR Inventor's Certificate No. 11,027,056, cl. B30B 1/18 published in the Bulletin "Discoveries, Inventions, Industrial Designs, Trade Marks", No. 25, 1983).

This known screw press comprises a frame with guideways and a first screw installed for rotation along the longitudinal axis of said frame. One end of the screw facing the press tool is kinematically associated with slides and the other end thereof is rigidly coupled with a flywheel rotated by any known drive. Disposed in the frame guideways concentric with the screw is an outer slide provided with two intercommunicated spaces. One of the spaces that faces the press tool accommodates an inner slide, while the other space houses a carrying element which is essentially a nut body in engagement with the first screw. The nut body is rigidly coupled with a hollow screw through the inner space of which the first screw is passed. The hollow screw is in engagement with another nut rigidly coupled with the inner slide. Two stops are disposed on the outer wall of the nut body symmetric about the axis thereof. A bearing surface of each of the stops has a slope relative to the longitudinal axis of the screw, opposite to the slope of the helix of the first screw. The known press is provided with a mechanism for braking the outer slide when it approaches the extreme bottom position. This mechanism comprises two fixed traverses each of which is rigidly coupled with the frame and has at least two ports. A T-shaped slot is made at a central portion, and two movable traverses are provided each of which is disposed above the fixed traverse. The movable traverse is spaced apart from the fixed traverse at a definite distance set by means of adjusting screws and has a T-shaped slot at the central portion. Installed in the T-shaped slots of each movable and fixed traverse is a strip which by its lower end freely rests on the upper plane of the outer slide while its other end is provided with a stop intended for interaction with the movable strip. A stop intended for interaction with the stop disposed on the surface of the nut body is installed for rotation about its axis on the movable strip in its lower portion facing the nut body. The ports of each fixed traverse accommodate elastic elements with which the movable traverse interacts by means of pushers.

When the outer slide moves towards the extreme bottom position each strip freely moves therewith until the moment the upper stop thereof starts to interact with the movable traverse.

During further movement of the outer slide the stops of the nut body interact with the lower stops of the strips before closing of the dies. The upper stops of the strips interact with the movable traverses which compress the elastic elements through the pushers due to which resistance forces arise between the lower stops of the strips and the stops of the nut body. The vectors of the resistance forces are perpendicular to the plane of interaction of the stops. Horizontal components of the resistance forces develop a torque causing the nut body to rotate.

When the known press operates, there is no rebound of the outer slide when the dies are closing. However, the embodiment of the braking mechanism in the form of two pairs of the fixed traverse and the movable traverse not associated kinematically with one another extends the change-over time of the braking mechanism when the nomenclature of parts to be press-forged is changed. This leads to reduction of the press output capacity.

Such a design embodiment of the braking mechanism prevents simultaneous interaction of the stop of each strip of the fixed traverse with a respective stop on the nut body which causes bending moments in threaded joints of the nut body with the screw, and the inner slide nut with the hollow screw, i.e. it causes the cross-threading which in its turn cuts down the press service life.

SUMMARY OF THE INVENTION

The invention has as its aim the provision of a double-action screw press, wherein a mechanism for braking the outer slide when it approaches the extreme bottom position will equalize the rotational speeds of the carrying element and the screw which will eliminate the rebound of the outer slide when the dies are closing, without any decrease in the output and reliability of the press, or in its efficiency. This is attained by a double-acton screw press comprising a frame with guideways and a first screw installed for rotation along the longitudinal axis of said frame. Installed in the frame guideways concentric with the first screw is an outer slide with guideways for an inner slide and with two intercommunicated spaces, one of which faces the press tool and accommodates the inner slide while the other space houses a carrying element with at least two disposed symmetric about the axis of the first screw and installed on its outer surface first stops. The bearing surface of each of the first stops has a slope relative to the longitudinal axis of the screw, opposite to the slope of helix of the first screw rigidly coupled with a first nut being in engagement with the first screw, and with a hollow screw encompassing the first screw and being in engagement with a second nut rigidly installed in the inner slide, and a mechanism for braking the outer slide when it approaches the extreme bottom position kinematically associated with the carrying element. According to the invention the braking mechanism is disposed on the face surface of the outer slide facing the first stops and comprises a plate disposed coaxially with the screw, provided with a through hole accommodating a carrying element, and equipped with a device for movement along the longitudinal axis of the first screw. The plate mounts elastic elements, a pair of which by means of a traverse is kinematically associated with a second stop installed in the traverse for turning, and interacting with the first stop by its sloping face surface the angle of slope of which coincides with the angle of slope of the first stop surface, further there are provided third stops rigidly coupled with the frame and interacting with the plate when the outer slide approaches the extreme bottom position.

Such a design embodiment of the press ensures minimum frictional losses of the energy, as the two second stops installed in the traverse interact with the two first stops installed on the carrying element only on a limited section, viz. on the section of braking of the outer slide when it approaches the extreme bottom position, thereby increasing the press efficiency.

Installation of the second stops on the plate ensures their simultaneous interaction with the stops installed on the carrying element which excludes the occurrence of bending moments in threaded joints of the carrying element nut with the screw and the inner slide nut with the hollow screw, i.e. prevents the cross-threading.

Provision of one plate in the braking mechanism facilitates the process of the press change-over when the nomenclature of parts to be press-forged is changed which leads to increase of the press output. Further, the installation of third stops in the press frame, viz. in the uprights thereof improves rigidity of the braking mechanism which excludes cocking between the plate and the frame during interaction of the stops on the carrying element with the second stops at braking of the outer slide.

Arrangement of the plate on the top face of the outer slide ensures a free movement of the latter to the extreme top and bottom positions which simplifies the design of the press and reduces the specific metal content and overall dimensions thereof. In addition the arrangement of the plate on the outer slide minimizes the plate travel in the guides and decreases the dimensions thereof.

It is desirable that the outer surface of the carrying element be provided with two shaped surfaces forming a cam and interacting with two spring-loaded pushers disposed symmetric about the axis of the carrying elements, each of which is installed in the guides on the surface of the plate opposite to its surface interacting with the third stop, and provided with a sloping surface intended for interaction with a sloping surface of the third stop at the end of the outer slide braking process.

Provision of the two shaped surfaces on the outer surface of the carrying element and presence of the two pushers installed on the plate and interacting with the third stops secured in the frame ensure a sequential movement of the inner and outer slides when they are moving upwards after the deformation process which leads to stability of the press forging process, viz. to a preset sequence in movement of the press tool components: a punch associated with the inner slide and a top die associated with the outer slide. This ensures reliable removal of a forging from the press tool. When the press is used for producing forgings with deep cavities the blank seizes in the punch and hinders the upward movement of the inner slide relative to the outer slide and removal of the blank from the punch. This, in its turn, enhances the seizure of the blank in the punch at cooling. This leads to the stopping of the press for a forced removal of the blank from the punch, spillage of the forging and a decrease in the press output.

It is preferred that the angle of slope of the face surface of the second stop, coinciding with the angle of slope of the bearing surface of the first stop and opposite to the slope of the screw helix relative to the horizontal surface be determined by the following relationship:

$$\alpha_2 = \text{arc}tg \frac{R_1}{R_2} \cdot tg\alpha_1,$$

where $R_1$ is a pitch radius of the screw thread;

$R_2$ is a distance from the axis of the screw to the axis of the second stop; and $\alpha_1$ is an angle of helix on the pitch diameter of the screw thread.

Only such relationship of the angles of slope ensures the stopping of the outer slide and minimum losses of energy at braking of the outer slide. This is explained by the fact that the energy spent for deformation of the elastic elements is returned for acceleration of the carrying element, viz. for increasing its rotational speed up to the rotational speed of the screw which will ensure the braking of the outer slide up to its complete stop. Such a design embodiment of the braking mechanism ensures maximum efficiency of the press.

BRIEF DESCRIPTION OF THE DRAWINGS

The exact nature and other advantages of the invention will become more apparent by reference to a specific embodiment thereof taken in conjunction with the accompanying drawings, wherein:

FIG. 3 is a section taken along the line III—III of FIG. 1;

FIG. 5 illustrates a plane of interaction of the first stop with the second stop and forces arising from the interaction thereof; and FIG. 6 is a graph illustrating variations of line speed V of the outer slide, rotational speed $\omega_1$ of the screw and rotational speed $\omega_2$ of the hollow screw versus braking time t of the outer slide.

BEST MODES OF CARRYING OUT THE INVENTION

Figure 1:
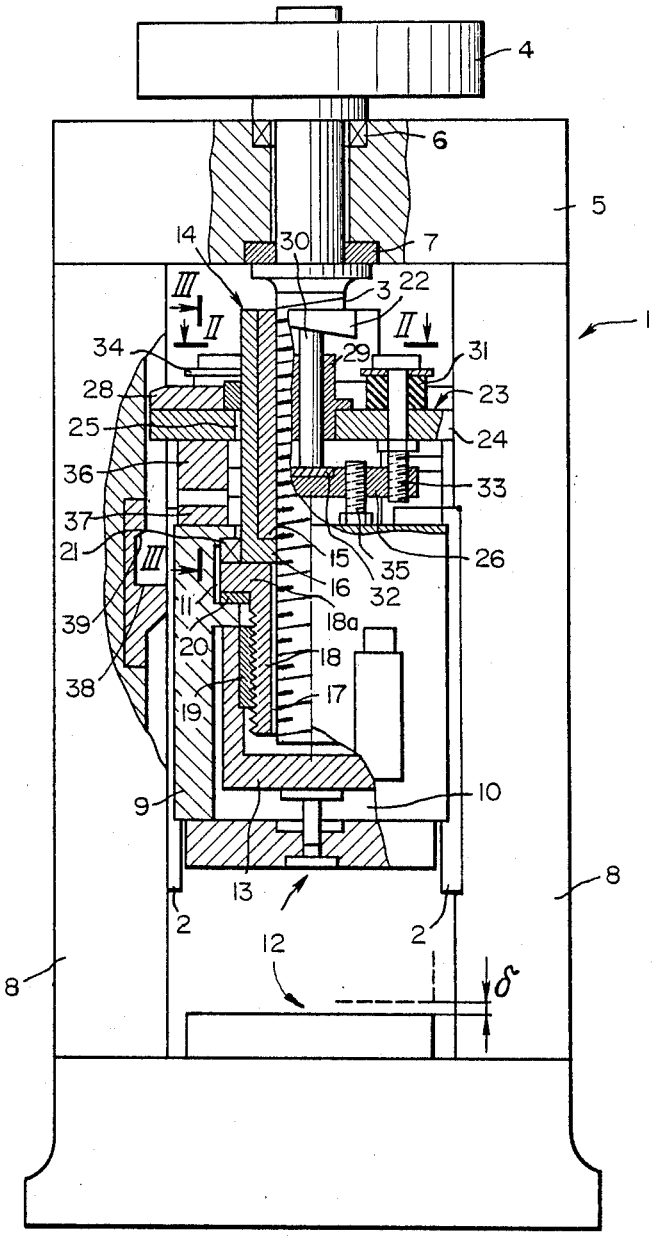
FIG. 1 is a diagrammatical view partly in longitudinal section of a double-action screw press according to the invention.

A double-action screw press embodied according to the invention is designed for the closed-die forging of precision parts of complicated configuration from ordinary and difficult-to-deform metals and alloys, for example, gears, couplings, T-pieces, cross-pieces, etc. The screw press comprises a frame 1 (FIG. 1) with guideways 2 and a screw 3 installed for rotation along the longitudinal axis of said frame. One end of the screw 3 is rigidly coupled with a flywheel 4 rotated by any known drive. The screw 3 rotates in a thrust bearing 6 and a step bearing 7 disposed in a traverse 5 of the frame 1. The guideways are installed on uprights 8 of the frame 1. Installed in said guideways for movement is an outer slide 9 provided with two intercommunicated spaces 10 and 11. The space 10 facing a press tool 12 accommodates an inner slide 13 and the space 11 houses a portion of a carrying element which is essentially a nut 14 of a composite metal. A threaded portion 15 of nut 14 is made of bronze and a nut body 16 is made of steel or cast iron. Nut 14 is kept in a threaded engagement with the screw 3. A lower end of the screw 3 freely passes via a through hole 17 of a hollow screw 18 rigidly coupled with the body 16 of the nut 14. The hollow screw 18 is in engagement with a second nut 19 rigidly installed in the inner slide 13, and rests by its flange 18a on a pivot 20 rigidly coupled with the outer slide 9. A thrust bearing 21 is disposed on the flange 18a of the hollow screw 18 in the space 11 of the outer slide 9. Installed on the outer surface of the body 16 of the nut 14 symmetric about the axis of said nut body are at least two first stops 22 the bearing surface of each of which has a slope relative to the longitudinal axis of the screw 3, opposite to the slope of helix thereof.

The press is provided with a mechanism 23 for braking the outer slide when it approaches the extreme bottom position. The mechanism 23 comprises a plate 24 having a through central hole 25 encompassing the body 16 of the nut 14 and disposed coaxially with the screw 3, and two traverses 26 kinematically associated with the plate 24. Installed on the surface of the plate 24 (FIG. 2) in guides 27 are spring-loaded pushers 28 disposed symmetric about the axis of the body 16 of the nut 14. Provided further on the plate 24 are two bushings 29 each of which accommodates a second stop 30 and four elastic elements 31 (FIG. 1) a pair of which are kinematically associated through the medium of the traverse 26 with the second stop 30. Each of the stops 30 is installed in the traverse 26 for turning and interacts by its one face surface made with a slope an angle $\alpha_2$ of which coincides with an angle $\alpha_2$ of slope of the surface of the first stop 22, with the first stop 22 and by its other face surface interacts through the medium of a step bearing 32, the traverse 26, adjusting screws 33 and a washer 34 with the two elastic elements 31.

The angle $\alpha_2$ is determined by the relationship:

$$\alpha_2 = \text{arc}tg \frac{R_1}{R_2} \cdot \alpha_1,$$

where:

$R_1$ is a pitch radius of the screw thread;

$R_2$ is a distance from the axis of the screw to the axis of the second stop;

$\alpha_1$ is an angle of helix on the pitch diameter of the screw thread.

By means of second adjusting screws 35, each of the traverses 26 rests on the top surface of the outer slide 9.

In addition, the plate 24 (FIG. 3) is adapted to move along the screw axis for which purpose said plate is provided with two ribs 36 each of which is installed in a guide 37 secured on the outer slide 9.

Provided in the uprights 8 (FIG. 1) of the press frame 1 are stops 38 (FIG. 4) for limiting the movement of the plate 24 (FIG. 1) when the outer slide 9 approaches the extreme bottom position and stops 39 (FIG. 4) for preventing the upward movement of the outer slide 9 until the inner slide 13 (FIG. 1) takes its extreme top position.

Figure 4:
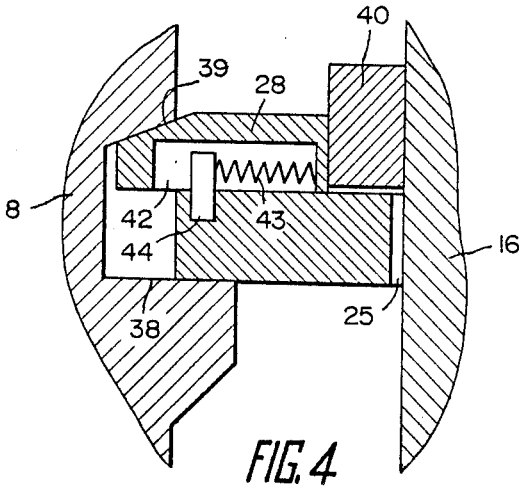
FIG. 4 is a section taken along the line IV—IV of FIG. 2 with both slides in the extreme bottom position.

The outer surface of the body 16 of the nut 14 is provided with two shaped surfaces 40 (FIG. 2) forming a cam and interacting with two pushers 28. On the side opposite to the side interacting with the cam, each of the pushers 28 has a sloping surface 41 intended for interaction with the stop 39 (FIG. 4). Each of the pushers 28 has an inner space accommodating a spring 43 one end of which is connected with the pusher and the other end is resting against a pin 44 press-fitted in the plate 24.

Figure 2:
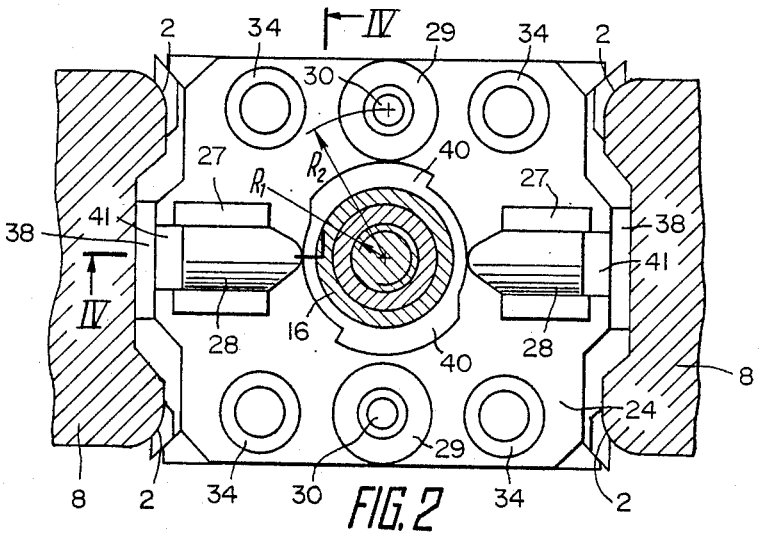
FIG. 2 is a section taken along the line II—II of FIG. 1.

The press operates in the following manner. Before operation the outer slide 9 (FIG. 1) and the hollow screw 18, the nut 14 and the plate 24 associated therewith are raised into the extreme top position, as shown in FIG. 1. The inner slide 13 occupies the extreme top position relative to the outer slide 9. In this case the pushers 28 (FIG. 2) are forced by the springs against the shaped surfaces 40 of the cam, the first stops 22 (FIG. 1) rest by their bevelled portions against the top portion of the second stops 30 and their lower face surfaces rest through the step bearings 32, the traverses 26, the adjusting screws 33 and the second adjusting screws 35 against the outer slide 9. As is clear from FIG. 1, the screws 35 contact the top member 9, and rotation of nut 14 will be prevented by way of stops 22 and 30.

When the press drive (not shown in the drawing) is switched on the flywheel 4 and the screw 3 associated therewith start to rotate rapidly, thereby forcing the rest of the movable parts, including the hollow screw 18, the inner slide 13 and the outer slide 9 with the plate 24 disposed thereon and the pushers 28, the guide bushings 29, the second stops 30, the traverses 26, the elastic elements 31 and the adjusting screws 33 and 35 associated with said plate downward. On the acceleration downstroke the body 16 of the nut 14 is not rotating, as it is braked.

Mutual movement of the outer slide 9 and the plate 24 continues until the moment the latter comes in contact with the stops 38 (FIG. 4) after which the plate 24 is stopped from moving downwardly and remains stationary. In this case the outer slide 9 (FIG. 1) is short of its extreme bottom position by a value δand continues to move down. The value δis adjusted by means of the second adjusting screws 35 which are set up after the setting up of the adjusting screws 33 defining the extreme position of the body 16 of the nut 14 before the beginning of operation. Thereafter the adjusting screws are locked by any known method (not shown in the drawing).

The first stops 22 act upon the elastic elements 31 through the medium of the second stops 30, the traverses 26, the first adjusting screws 33 and the washers 34. A force F (FIG. 5) of resistance to the movement of the first stops 22 and the body 16 of the nut 14, the hollow screw 18, the outer slide 9 and the inner slide 13 associated with said first stops, is developed and directed normal to the plane of contact of the first stops 22 and the second stops 30.

Under the action of a force $F_2$, a component of the force F, a torque is set up on the body 16 of the nut 14:

$$M_2 = F_2 \cdot R_2, \tag{1}$$

where:

$F_2$ is a horizontal component of the force F acting on the first stops 22;

$R_2$ is a radius of action of the force $F_2$ on the first stops 22 equal to the distance from the screw axis to the second stop axis.

The force $F_1$, a component of the force F, is transmitted from the first stops 22 installed on the body 16 of the nut 14 to the screw 3 and develops a torque:

$$M_1 = F_1 \cdot R_1 \cdot tg\alpha_1, \tag{2}$$

where:

$F_1$ is a vertical component of the force F acting on the first stops 22;

$R_1$ is a pitch radius of the thread of the screw 3;

$\alpha_1$ is an angle of the screw helix on the pitch diameter of the thread of the screw 3.

$$F_1 = F_3, \tag{3}$$

where:

$F_3$ is a force developed by the elastic elements 31.

Then $$F_2 = F_3 l \cdot tg\alpha_2, \tag{4}$$

where:

$\alpha_2$ is an angle of slope of the face surface of each of the first stops 22 relative to the horizontal plane, equal to the angle of slope of the face surface of each of the second stops 30.

The torques $M_1$ and $M_2$ act in the direction of rotation of the screw 3 and develop a total torque M accelerating the nut 14 in the direction of rotation of the screw 3.

$$M = M_1 + M_2, \tag{5}$$

Substituting (3) and (4) into (5) with regard to (1) and (2), we obtain:

$$M = F_3(R_1 \cdot tg\alpha_1 + R_2 \cdot tg\alpha_2), \tag{6}$$

where:

$F_3 = c \cdot S$ is a force developed by the elastic elements 31:

e is a reduced linear stiffness of the elastic elements 31;

S is a deformation of the elastic elements 31 during acceleration of the nut 14.

Under the action of the total torque M the nut 14 starts to rapidly rotate in the direction of rotation of the screw 3.

The speed of movement of the outer slide 9 decreases 15 and is determined by the expression:

$$V = (\omega_1 - \omega_2)\frac{h_1}{2\pi}, \tag{7}$$

where:

$\omega_1$ is a rotational speed of the screw 3;

$\omega_2$ is a rotational speed of the nut 14;

$h_1$ is a lead of thread of the screw 3.

The rotational speed $\omega_2$ of the nut 14 may also be obtained by solving the equation of motion:

$$\omega_2 = \frac{a}{a+b} \cdot \omega_1 (1 - \mathrm{Cos}\omega_o t), \tag{8}$$

where:

$a = R_1 \cdot tg\alpha_1$;

$b = R_2 \cdot tg\alpha_2$;

$\omega_o$ is a natural resonant frequency of the system $$\omega_o = (a+b)\sqrt{6/y^*}, \tag{9}$$

where:

$y^*$ is an equivalent moment of inertia of the movable parts.

From the equation (8) we find the parameters at which the rotational speed of the nut 14 will reach the rotational speed of the screw 3:

$$\omega_2 = \frac{a}{a+b} \cdot \omega_1 (1 - \mathrm{Cos}\omega_o t) = \omega_1$$

$\omega_2 =$ max, at $\mathrm{Cos}\,\omega_o t = -1$

Then $$\omega_1 = \frac{2a}{a+b} \cdot \omega_1 \text{ or } 2a = a + b$$

Hence:

$$2R_1 \cdot tg\alpha_1 = R_1 \cdot tg\alpha_1 + R_2 \cdot tg\alpha_2 \quad (10)$$

Usually $R_1$ and $\alpha_1$ are prescribed, while $R_2$ is determined physically, then $$\alpha_2 = \mathrm{arc}tg \frac{R_1}{R_2} \cdot tg\alpha_1 \quad (11)$$

The process of braking the outer slide 9 comprises two stages. In the first stage when the rotational speed of the nut 14 is low the elastic elements 31 are compressed and store up the strain energy. In the second stage the nut 14 is accelerated and the outer slide 9 is braked at the expense of the stored up strain energy of the elastic elements 31 which converts into the kinetic energy of rotation of the nut 14.

The value δof the braking stroke of the outer slide 9 is preset so that on the braking stroke of the outer slide 9 when the stored up strain energy of the elastic elements 31 is completely given up for acceleration of the nut 14 the rotational speed $\omega_2$ (FIG. 6) of the nut 14 should be equal to the rotational speed $\omega_1$ of the screw 3.

At the end of the braking stroke of the outer slide 9 $\omega_1 = \omega_2$ and its speed V is equal to zero.

Thus a shockless closing of the dies of the press tool 12 is accomplished.

At the moment the dies of the press tool 12 are being closed the speed of the inner slide equals $$V = \omega_2 \cdot \frac{h_2}{2}, \quad (12)$$

where: $h_2$ is a lead of the thread of the hollow screw 18.

During the braking stroke the body 16 of the nut 14 turns through an angle at which the shaped surfaces 40 of the cam installed on the body 16 for adjustment (not shown in the drawing) act on the pushers 28 with the bevelled portions, thereby causing them to move radially until they come in contact with the bevelled portions of the stop 39. During further turning of the body 16 the shaped surfaces 40 of the cam come in contact with the pushers 28 by their surfaces of the constant radius due to which the pushers 28 remain motionless. At this moment the press tool 12 "meets" the blank (not shown in the drawing) and the stroke of deformation takes pace until the energy of the movable parts completely transforms into the work of blank deformation. At the end of the deformation stroke the body 16 of the nut 14 is stopped, the drive, the flywheel 4 and the screw 3 are reversed in the direction opposite to the angle of turning of the body 16 during the working stroke.

Upward movement of the outer slide 9 will be possible only if the body 16 of the nut 14 turns in the direction of rotation of the screw 3 to a position in which the cam of the shaped surfaces 40 ensures the movement of the pushers 28 towards the center. Rotation of the body 16 ensures the raising of the inner slide 13 up to the extreme top position relative to the outer slide 9 in which case the first stops 22 by the bevelled portions thereof come in contact with the bevelled portions of the second stops 30. Thereafter the body 16 of the nut 14 is stopped and the movable parts are raised up in the extreme top position. When the movable parts approach the top position the drive is switched off and the brake of the flywheel 4 is applied (the brake is not shown in the drawing; when the cycle "down-stroke" is switched on the brake is released). The cycle is completed.

INDUSTRIAL APPLICABILITY

The proposed design of a double-action screw press ensures a preset mode of operation with shockless closing of the press tool, sequential movement of the inner slide into the extreme top position relative to the outer slide and the mutual upward movement of both slides after the deformation stroke. This makes it possible to widen the engineering capabilities of the equipment, guarantee the production of quality parts, minimize the loads on the press and the press tool elements, and to extend their service life.

Design of the press makes it possible to simplify its manufacture and operation, as the specialized equipment of the given kind is intended for the closed-die forging in conditions of a lot or a small-lot production characterized by frequent replacements of the tooling and resetting of the device for shockless closing of the dies, and by the sequential movement of the inner slide relative to the outer slide.

Moreover, the press is used to advantage for producing parts with the type of flanged bushings and gears with press-forged teeth. The proposed method, when compared with the production of similar parts by the method of an open-die forging provides the following advantages:

savings of metal up to 25-35%;

increase of the labour productivity by 30%;

decrease of labour content by 20-25% at the expense of reducing the number of sequential operations;

reduction of the press forging force by 1.5-2 times;

improvement in the precision of forgings by one accuracy degree;

simplification of the press forging mechanization and automation.

We claim:

1. A double-action screw press comprising:

a frame for receiving a load and including upper and lower traverses interconnected by two vertical uprights, the lower traverse of said frame secured to a foundation, the two vertical uprights spaced apart from each other and securely fastened on said lower traverse, the upper traverse of said frame mounted on said two vertical uprights;

a first plurality of guideways, at least one of said guideways disposed on each of said two vertical uprights along a longitudinally extending axis of said frame;

a first screw rotatably mounted with respect to the axis of said frame and fastened in said upper traverse;

an outer slide positioned concentrically with said first screw, guided by said first plurality of guideways and having two coaxially arranged, intercommunicated spaces formed therein;

a press tool received within one of said intercommunicated spaces;

a second plurality of guideways provided on an inner surface of said outer slide and located in said one of said interconnected spaces;

an inner slide mounted on said second plurality of guideways and having a space formed therein arranged coaxially to said first screw;

a first nut in engagement with said first screw and arranged concentrically with the axis of said first screw;

a second nut placed in the space formed in said inner slide and rigidly mounted on an inner side surface of said inner slide;

a hollow screw, embracing said first screw, in engagement with said second nut, said hollow screw rigidly connected with a nut body of said first nut, said nut body forming a carrying member;

at least two first stops arranged symmetrically to the axis of said first screw and mounted on the outer surface of said carrying member, each of said first stops including a supporting surface having an angle of inclination opposite to the inclination of helical threads of said first screw; and a braking mechanism for braking said outer slide, when it approaches an extreme bottom position, comprising:

(1) a plate for braking the outer slide, arranged perpendicularly to the axis of said first screw, movable along the axis of said first screw and having a through hole arranged concentrically with said first screw, said plate embracing said carrying member;

(2) elastic elements located on a surface of said plate facing said at least two first stops;

(3) traverses installed between said plate and an upper face surface of said outer slide and kinematically coupled with a pair of said elastic elements;

(4) screws, a pair of which is connected with each of said traverses by first threaded ends, second ends of said pair of screws including heads thereon resting on the upper face surface of said outer slide;

(5) second stops, each of which is mounted for rotation relative to the axis thereof in said plate and interacts with one of said traverses at one end thereof and with one of said at least two first stops by means of an inclined face surface at the opposite end thereof, the inclined face surface having an angle of inclination coinciding with the angle of inclination of the support surface of said at least two first stops; and (6) two stops for limiting movement of said plate for braking the outer slide, each being rigidly coupled with one of said two vertical uprights and having sloping and horizontal thrust faces interacting with said plate to limit movement of said plate when said outer slide approaches its extreme bottom position.

2. A double-action screw press as set forth in claim 1, and further comprising:

two shaped surfaces provided on the outer side surface of said carrying member, each of said two shaped surfaces forming a cam;

guides located on the surface of said plate on which said elastic elements are located and being disposed symmetrically on opposite sides of said plate; and two spring-loaded pushers, each being mounted in one of said guides and having two end portions, one of which interacts with one of said shaped surfaces and the other of which has a sloping surface interacting with the sloping surface of one of said two stops for limiting movement of said plate for braking the outer slide.

3. A double-action screw press as set forth in claim 1, in which the inclined face surface of each of said second stops is oriented at an angle coinciding with the angle of inclination of said supporting surface of each of said at least two first stops and is defined by the relationship $$\alpha_2 = \text{arc}tg \frac{R_1}{R_2} \cdot tg\, \alpha_1,$$

wherein $R_1$ is a pitch radius of the screw thread, $R_2$ is a distance from the axis of the screw to the axis of each of the second stops;

$\alpha_1$ is a helix angle on the pitch diameter of the screw thread, and $\alpha_2$ is the angle at which the inclined face surface of each of said second stops is oriented.

4. A double-action screw press as set forth in claim 2, in which the inclined face surface of each of said second stops is oriented at an angle coinciding with the angle of inclination of said supporting surface of each of said at least two first stops and is defined by the relationship $$\alpha_2 = \text{arc}tg \frac{R_1}{R_2} \cdot tg\, \alpha_1,$$

wherein $R_1$ is a pitch radius of the screw thread, $R_2$ is a distance from the axis of the screw to the axis of each of the second stops, $\alpha_1$ is a helix angle on the pitch diameter of the screw thread, and $\alpha_2$ is the angle at which the inclined face surface of each of said second stops is oriented.

* * * * *